US009090381B2

(12) United States Patent
Yang

(10) Patent No.: US 9,090,381 B2
(45) Date of Patent: Jul. 28, 2015

(54) ILLUMINATED BOTTLE STOPPER

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 170 days.

(21) Appl. No.: 13/831,647

(22) Filed: Mar. 15, 2013

(65) Prior Publication Data

US 2014/0268677 A1 Sep. 18, 2014

(51) Int. Cl.

| | |
|---|---|
| ***B65D 39/00*** | (2006.01) |
| ***F21V 33/00*** | (2006.01) |
| ***G09F 13/00*** | (2006.01) |
| ***G09F 13/18*** | (2006.01) |
| ***G09F 23/08*** | (2006.01) |
| ***B65D 51/24*** | (2006.01) |
| *F21Y 101/02* | (2006.01) |
| *G09F 13/22* | (2006.01) |

(52) U.S. Cl.

CPC ..... *B65D 39/00* (2013.01); *B65D 39/0058* (2013.01); *B65D 51/248* (2013.01); *F21V 33/0036* (2013.01); *G09F 13/00* (2013.01); *G09F 13/18* (2013.01); *G09F 23/08* (2013.01); *F21Y 2101/02* (2013.01); *G09F 2013/222* (2013.01)

(58) Field of Classification Search

USPC ..... 362/101, 154, 155, 184; 222/113; 215/200, 228, 230, 355; 40/546, 547

See application file for complete search history.

(56) References Cited

U.S. PATENT DOCUMENTS

| | | | | | |
|---|---|---|---|---|---|
| 4,227,327 | A * | 10/1980 | Thompson | 40/473 |
| 5,027,258 | A * | 6/1991 | Schoniger et al. | 40/547 |
| 5,075,826 | A * | 12/1991 | Lan | 40/546 |
| 5,572,818 | A * | 11/1996 | Churchill | 40/547 |
| 5,586,691 | A * | 12/1996 | Gotch et al. | 222/113 |
| 6,712,493 | B2 * | 3/2004 | Tell et al. | 362/565 |
| 6,902,304 | B2 * | 6/2005 | Yang | 362/101 |
| 7,246,932 | B2 * | 7/2007 | Burtsev et al. | 362/616 |
| 8,052,003 | B2 * | 11/2011 | Burns | 215/355 |
| 8,733,584 | B2 * | 5/2014 | Auzenne | 215/230 |
| 2009/0122524 | A1 * | 5/2009 | Yang | 362/101 |

* cited by examiner

*Primary Examiner* — Ismael Negron
(74) *Attorney, Agent, or Firm* — Leong C. Lei

(57) ABSTRACT

A blinking wine bottle stopper includes a base, a power supply unit, and a light guide unit. The base has a receiving chamber having an opening The receiving chamber receives therein a light-emitting unit and the power supply unit. The light guide unit is fixed in the opening of the base to correspond to the light-emitting unit so that light emitting from the light-emitting unit is allowed to travel into and spread in the light guide unit.

4 Claims, 7 Drawing Sheets

ILLUMINATED BOTTLE STOPPER

TECHNICAL FIELD OF THE INVENTION

The present invention generally relates to a bottle stopper, and more particularly to a wine bottle stopper that emits light to improve the decoration of wine bottle and value of collection.

DESCRIPTION OF THE PRIOR ART

Wines are generally contained in bottle that uses a stopper made of cork to tightly close the bottle opening for preventing invasion of air in order to achieve long term storage. The cork, when being opened, is easily damaged, making it impossible for re-use.

Further, for those wine lovers, finding a particularly shaped stopper to match the bottle of valuable wine is generally very difficult for besides being seemingly noble, the stopper must match the bottle for various aspects. For example, wine or bottle-contained object that is produced at a special season or festival can be associated with the design of stopper so tht the stoppers that may be of various designs, when fit to a bottle, indeed provides a key influence on the entire product. Thus, there is still a great space to be filled for stopper design.

SUMMARY OF THE INVENTION

The primary object of the present invention is to overcome the problem that the conventional wine bottle stoppers lack eye-catching decorations and cannot enhance product value due to the outside appearance thereof and poor visual design.

Thus, the present invention provides a blinking wine bottle stopper, which comprises:

a base, which comprises a receiving chamber formed therein, the receiving chamber receiving a light-emitting unit mounted therein, the base comprising an opening in communication with the receiving chamber, the base comprising a plug mounted thereto opposite to the opening, the light-emitting unit comprising a substrate and at least two light-emitting elements mounted to the substrate;

a power supply unit, which is received in the receiving chamber of the base, the power supply unit being electrically connected to the light-emitting unit; and a light guide unit, which is received and fixed in the opening of the base to correspond to the light-emitting unit, the light guide unit comprising a light guide assembly and at least a light incident section, the light incident section being received in the opening of the base to contact the light-emitting unit, the light guide assembly comprising at least a first light guide plate and a second light guide plate, the first light guide plate and the second light guide plate being set to overlap each other, the first light guide plate and the second light guide plate being each provided with a pattern in such a way that the patterns are staggered with respect to each other.

The features and advantages of the present invention are as follows:

(1) The present invention provides an eye-catching outer appearance and visual effect so as to provide a brilliant, shinning and eye-attracting effect to thereby improving the use of the present invention and lowering the chance of being disposed of after use.

(2) The present invention enable emission of brilliant and shining light so that when mounted to a wine bottle, the present invention provide an eye-catching effect and thereby increasing the value of collection of the wine bottle.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
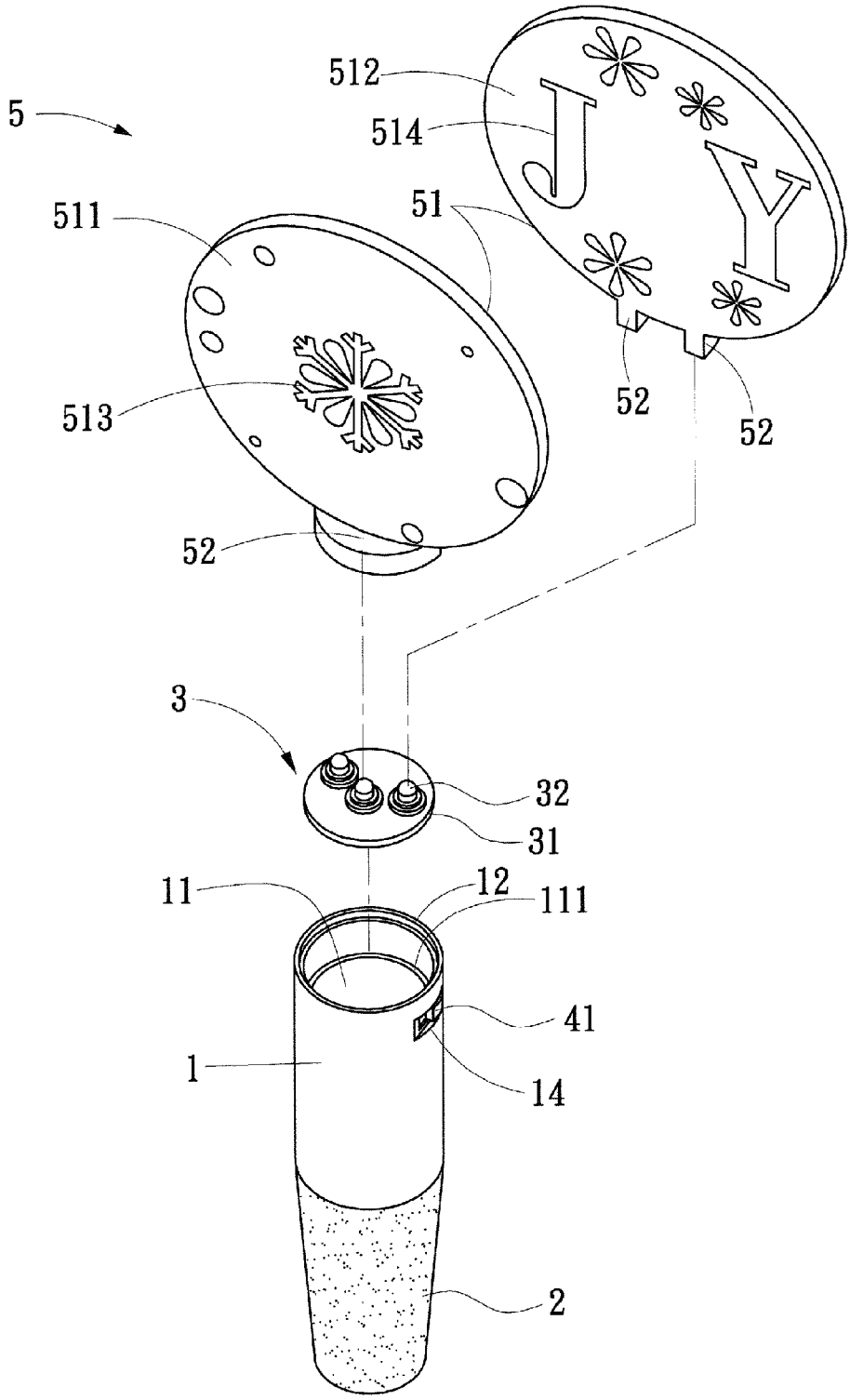
FIG. 1 is an exploded view showing a first preferred embodiment according to the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1-4, a blinking wine bottle stopper constructed according to a first preferred embodiment is shown, comprising: a base (1), a plug (2), a light-emitting unit (3), a power supply unit (4), and a light guide unit (5).

Figure 3:
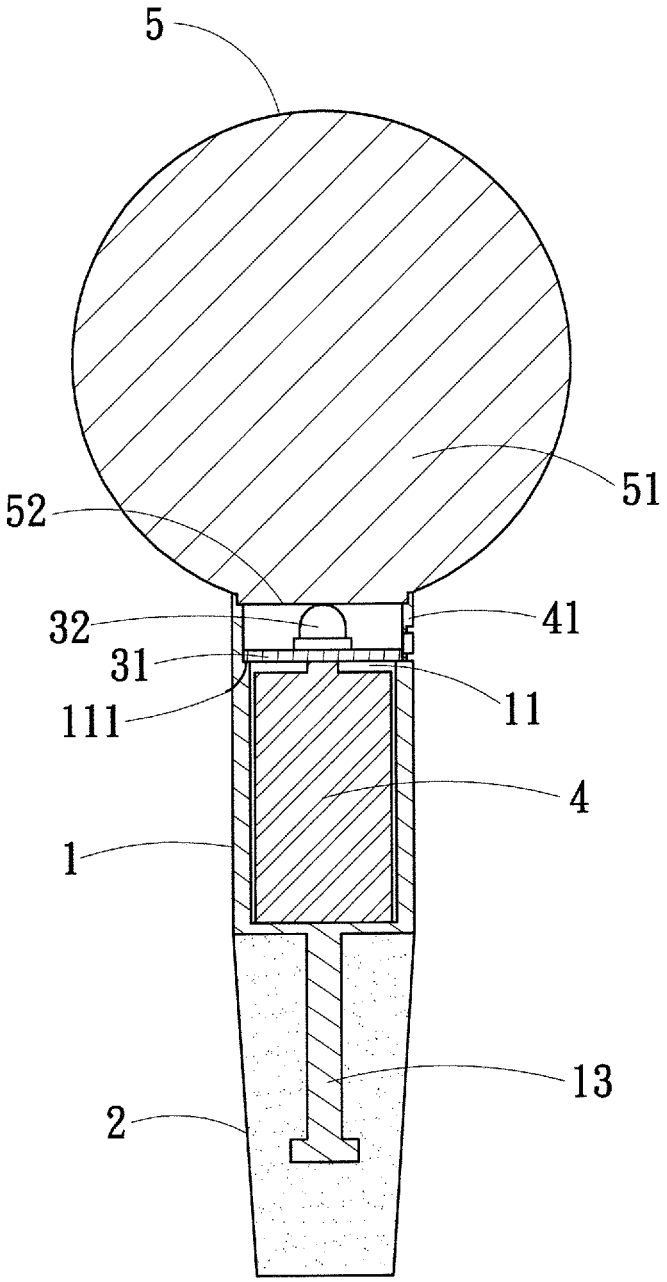
FIG. 3 is a cross-sectional view of the first embodiment of the present invention.
Figure 4:
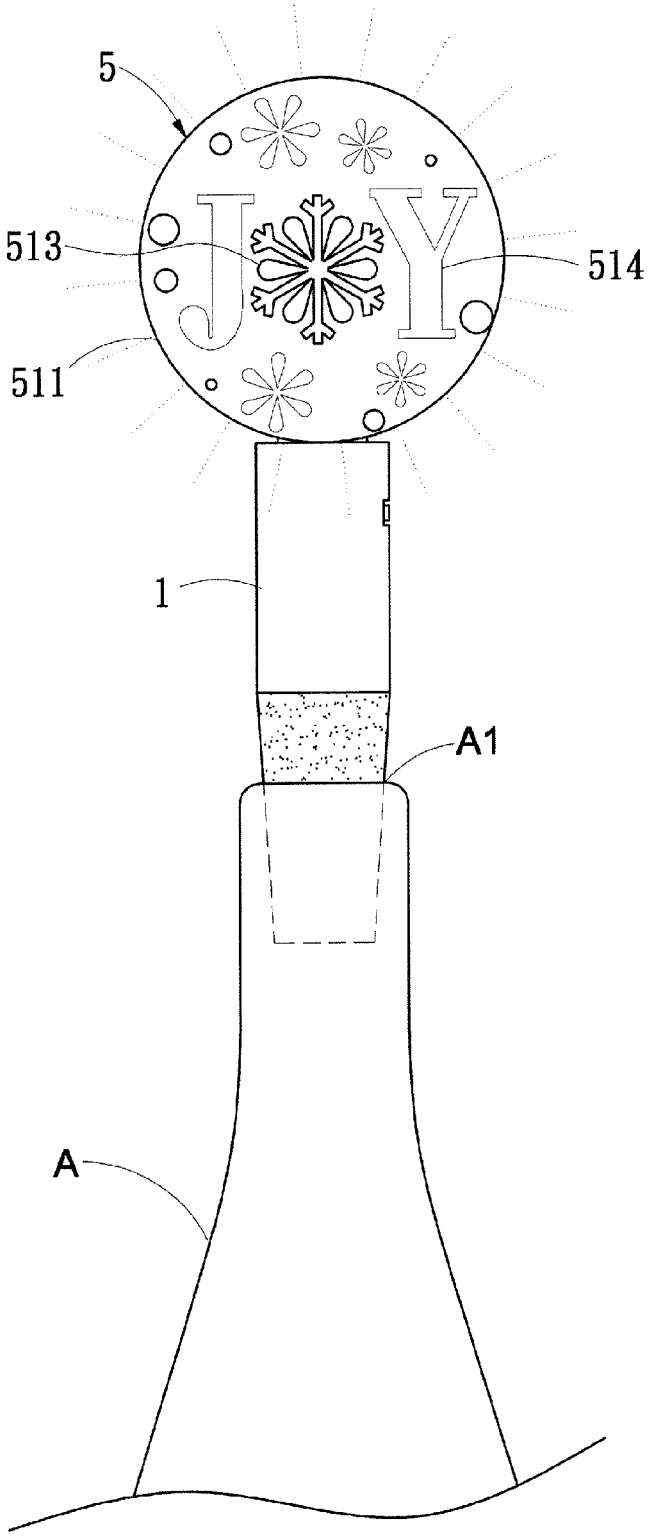
FIG. 4 is a schematic view showing the first embodiment of the present invention mounted to a wine bottle.

As shown in FIGS. 1 and 3, the base (1) comprises a receiving chamber (11) formed therein. Further, the base (1) has an outer circumferential wall which delimits an opening (12) in communication with the receiving chamber (11). A step (111), preferably a circumferential step, is formed in an inside surface of the receiving chamber (11). The plug (2) is connected to the base (1). The base (1) comprises a coupling section (13) extending from a connection thereof with the plug (2). In the instant embodiment, the coupling section (13) is of a T-shape. In manufacturing the base (1), the plug (2) can be formed on the base (1) so that the coupling section (13) of the base (1) is securely coupled to the plug (2) as a unitary structure without separation. Further, the plug (2) is made of a soft and flexible material in order to seal a mouth (A1) of a wine bottle (A) (as shown in FIG. 4).

Figure 2:
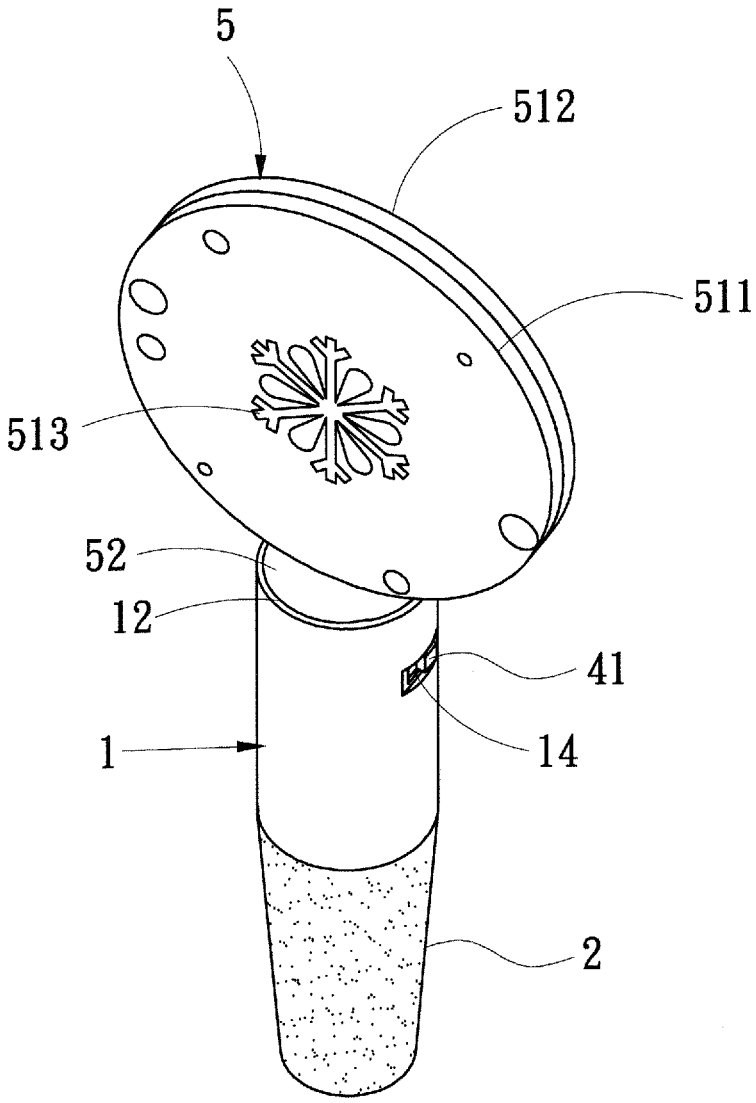
FIG. 2 is a perspective view, in an assembled form, of the first embodiment of the present invention.

As shown in FIGS. 2 and 3, the light-emitting unit (3) is mounted in the receiving chamber (11) of the base (1). The light-emitting unit (3) comprises a substrate (31) and at least a light-emitting element (32). In the instant embodiment, three light-emitting elements (32) are illustrated as an example for explanation. The substrate (31) is positioned on and supported by the step (111) formed in the receiving chamber (11) of the base (1). The light-emitting elements (32) are mounted on the substrate (31) in such a way that the light-emitting elements (32) face the opening (12) of the base (1). In the instant embodiment, the light-emitting elements (32) comprise light-emitting diodes (LEDs). Further, the power supply unit (4) is received in the receiving chamber (11) of the base (1) and is electrically connected to the light-emitting elements (32) of the light-emitting unit (3). In the instant embodiment, the power supply unit (4) comprises a battery. A hole (14) is formed in the circumferential wall of the base (1) and a power switch (41) is arranged in the hole (14). The power switch (41) is in electrical connection with the power supply unit (4), so that actuation of the power switch (41) controls power supply from the power supply unit (4) to activate the light-emitting elements (32) to be selectively in a light-on condition or a light-off condition.

The light guide unit (5) is fixed by a fixing means (such as screwing or interference fitting) to the opening (12) of the base (1) to correspond in position to the light-emitting unit (3). In the instant embodiment, the light guide unit (5) is fixed in the opening (12) of the base (1) through interference fitting. In the instant embodiment, the light guide unit (5) comprises a light guide assembly (51). The light guide assembly (51) comprises at least a first light guide plate (511) and a second light guide plate (512). The first light guide plate (511) and the second light guide plate (512) are both made of light-transmitting materials. Further, the first light guide plate (511) and the second light guide plate (512) are each provided with patterns (513, 514). The patterns (513, 514) are arranged to be staggered with respect to each other. The first light guide plate (511) has an outer circumference on which a light incident section (52) is formed. The second light guide plate (512) has an outer circumference on which two spaced light incident sections (52) are formed. The light incident sections (52) are received in the opening (12) of the base (1) and in contact with the light-emitting elements (32) of the light-emitting unit (3) to allow the light emitting from the light-emitting elements (32) to travel through the light incident sections (52) into and spreads through the light guide assembly (51). The patterns (513, 514) of the light guide assembly (51) help give off brilliant shining light (see FIG. 4). Thus, properly assembling these components as described above provides a device that has an outstanding outside appearance and visual effect and also shows a shinning eye-attracting effect.

Figure 5:
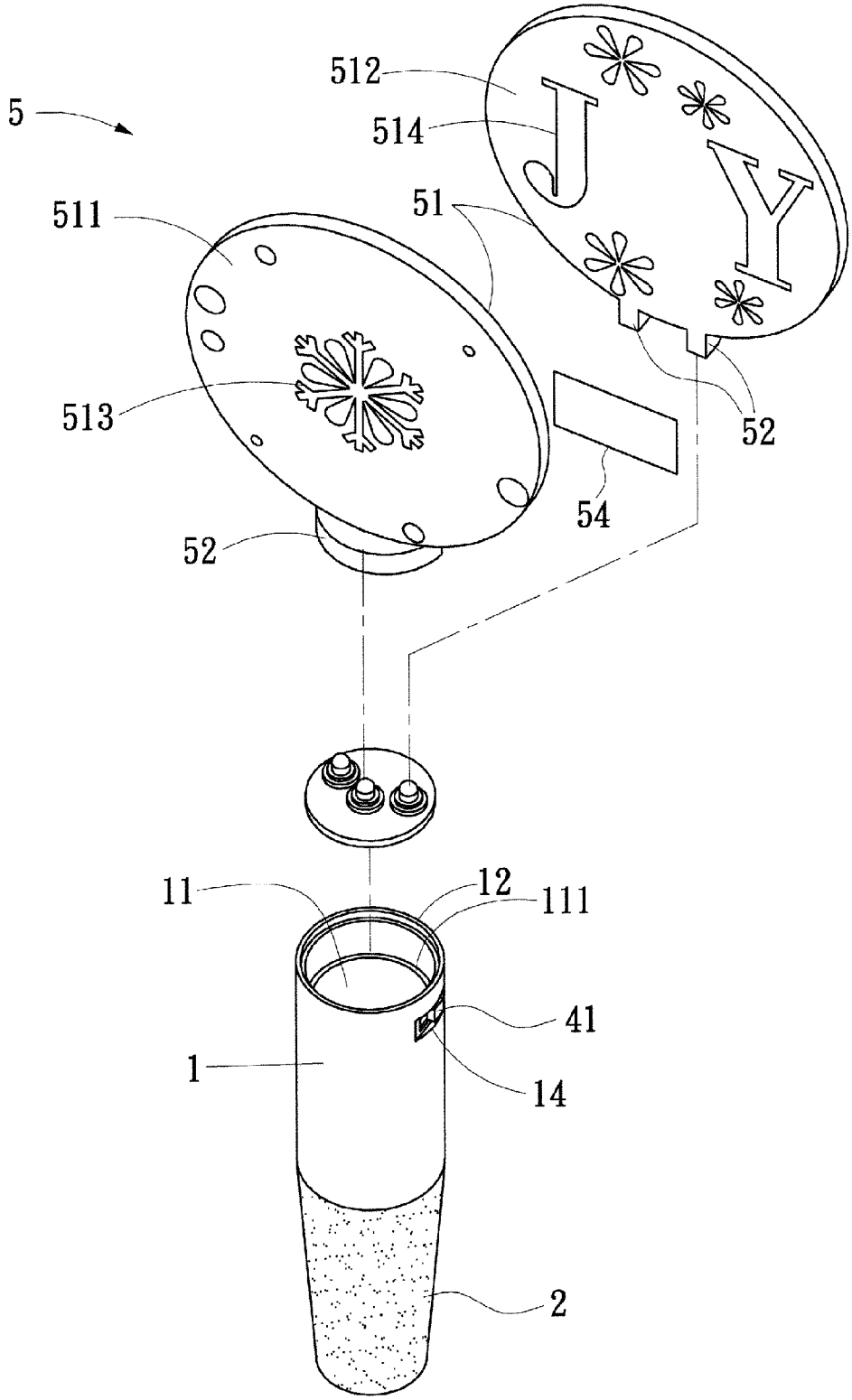
FIG. 5 is an exploded view showing a second preferred embodiment according to the present invention.

Referring to FIG. 5, a blinking wine bottle stopper according to a second embodiment of the present invention is shown. In the second embodiment, the base, the light-emitting unit, the power supply unit, and the light guide unit (5) are generally identical to the counterparts thereof shown in the first embodiment and repeated description will be omitted. Thus, in the instant embodiment, a light-shielding sheet (54) is arranged between the light incident sections (52) of the first light guide plate (511) and the second light guide plate (512) for eliminating mutual interference between adjacent ones of the light-emitting elements (32) for the first light guide plate (511) and the second light guide plate (512) are both made of light-transmitting materials. The light-shielding sheet (54) is provided to shield the starting point where light is emitted, namely being arranged between the light incident sections (52) that are in contact with the light-emitting element (32) so as to prevent light from spreading to the adjacent light guide plate.

Figure 6:
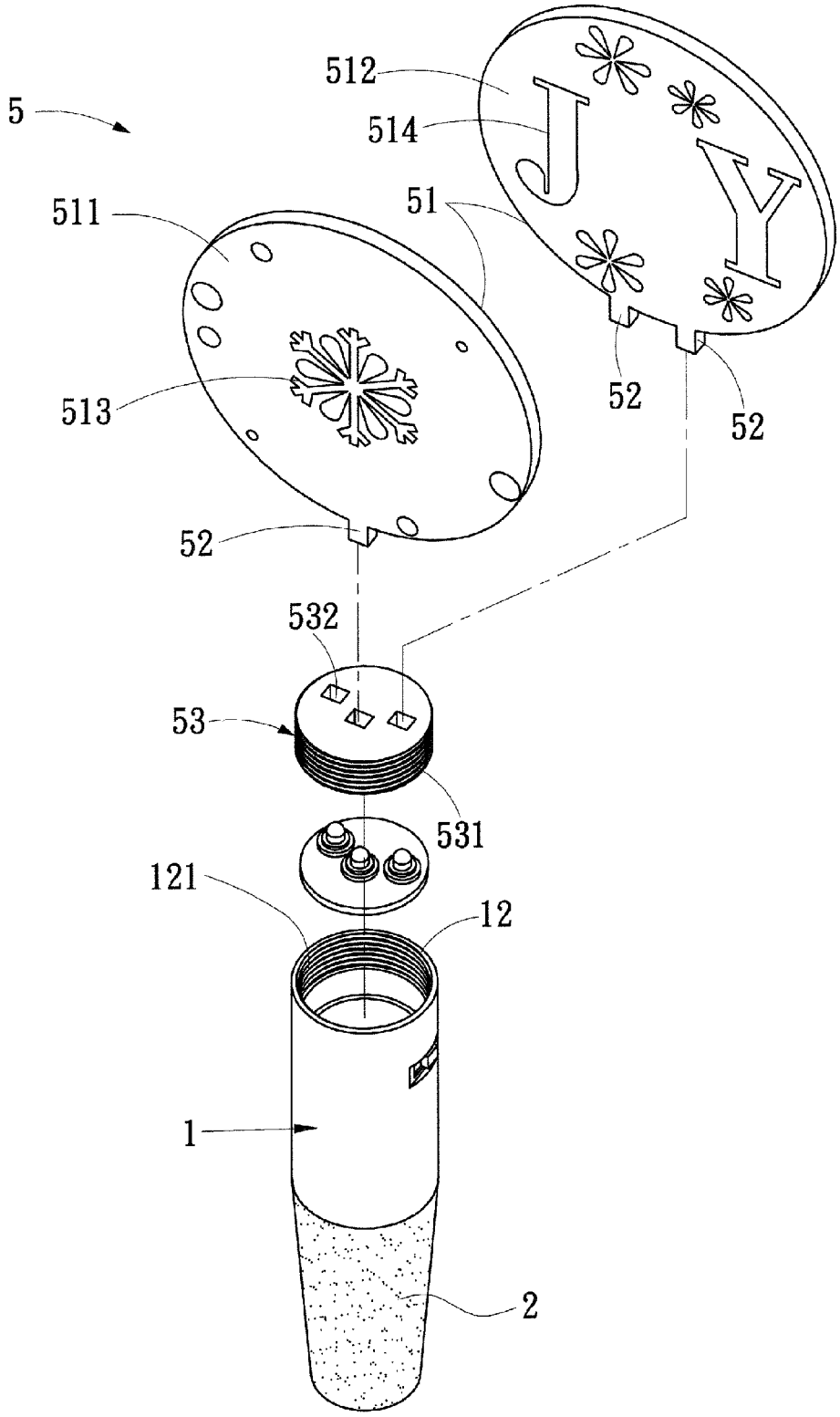
FIG. 6 is an exploded view showing a third preferred embodiment according to the present invention.
Figure 7:
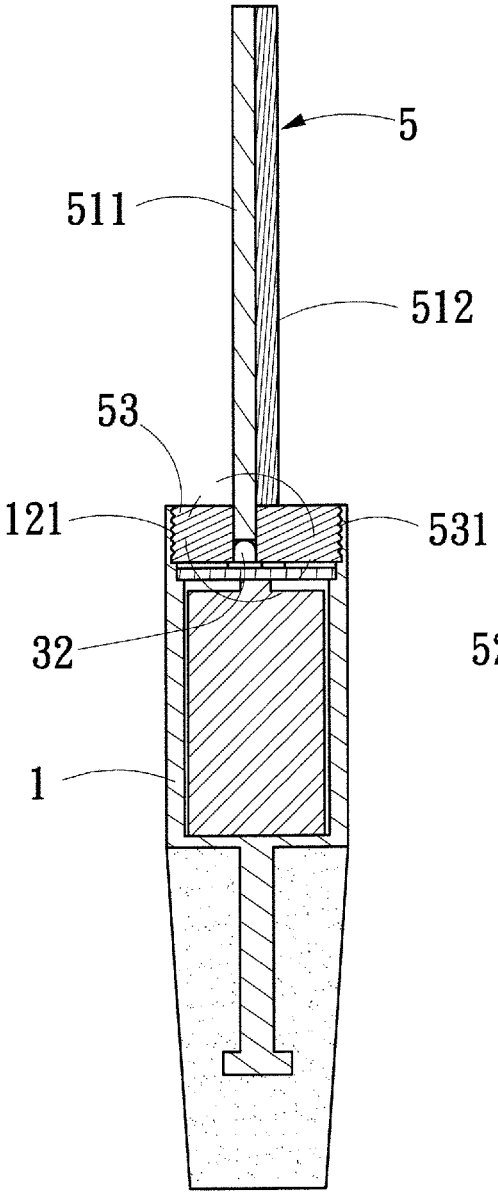
FIG. 7 is a cross-sectional view of the third embodiment of the present invention.
Figure 8:
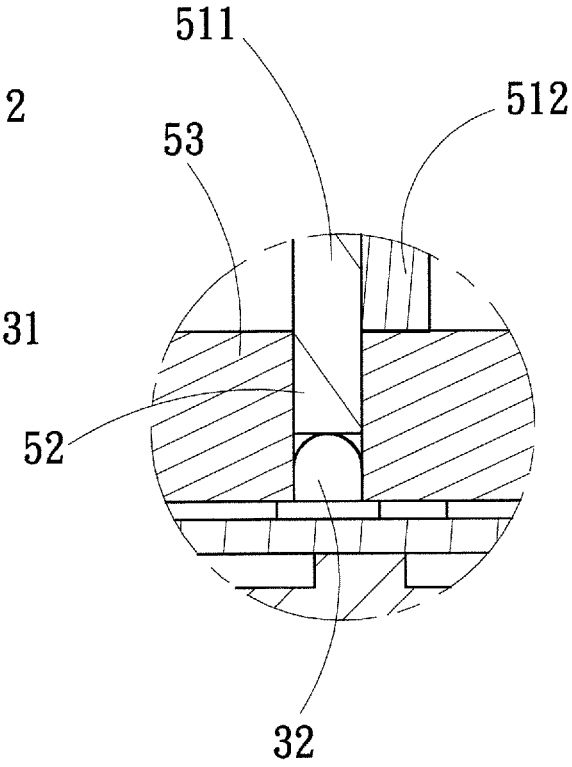
FIG. 8 is an enlarged view of a portion of FIG. 7.

Referring to FIGS. 6-8, a blinking wine bottle stopper constructed according to a third embodiment of the present invention is shown. In the third embodiment, the light-emitting unit, the power supply unit, and the light guide unit (5) are generally identical to the counterparts thereof shown in the first embodiment and repeated descriptions of these components will be omitted. In the instant embodiment, the light guide unit (5) comprises a light guide assembly (51), at least a light incident section (52), and a fixing plate (53). The light guide assembly (51) comprises at least a first light guide plate (511) and a second light guide plate (512). The first light guide plate (511) and the second light guide plate (512) are both made of light-transmitting materials. The first light guide plate (511) has an outer circumferential forming a light incident section (52). The second light guide plate (512) has an outer circumference forming two spaced light incident sections (52). The fixing plate (53) is received and fixed in the opening (12) of the base (1). The fixing plate (53) has an outer circumferential surface forming an external thread (531). The opening (12) of the base (1) has an inside surface forming an internal thread (121). The fixing plate (53) is fixed to the opening (12) of the base (1) by screwing. Further, the fixing plate (53) comprises through holes (532) formed therein to respectively correspond to the locations where the light incident sections (52) are set so that the through holes (532) receive the light incident sections (52) to extend therethrough to contact the light-emitting elements (32) of the light-emitting unit (see FIGS. 7 and 8), whereby light emitting from the light-emitting elements (32) is allowed to travel through the light incident sections (52) into and spread in the first light guide plate (511) and the second light guide plate (512). Further, the first light guide plate (511) and the second light guide plate (512) are each provided with patterns (513, 514) in such a way that the patterns (513, 514) are staggered with respect to each other to allow the light guide unit (5) to give off shining lights of various layers and thus being more brilliant. Thus, the present invention allows light to be given off in a more shining and brilliant fashion so as to provide an eye-catching decoration when mounted to a wine bottle and thus increase the value of collection of the wine bottle.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A blinking wine bottle stopper, comprising:

a base, which comprises a receiving chamber formed therein, the receiving chamber receiving a light-emitting unit mounted therein, the base comprising an opening in communication with the receiving chamber, the base comprising a plug mounted thereto opposite to the opening, the light-emitting unit comprising a substrate and at least two light-emitting elements mounted to the substrate;

a power supply unit, which is received in the receiving chamber of the base, the power supply unit being electrically connected to the light-emitting unit; and a light guide unit, which is received and fixed in the opening of the base to correspond to the light-emitting unit, the light guide unit comprising a light guide assembly and at least a light incident section, the light incident section being received in the opening of the base to contact the light-emitting unit, the light guide assembly comprising at least a first light guide plate and a second light guide plate, the first light guide plate and the second light guide plate being set to overlap each other, the first light guide plate and the second light guide plate being each provided with a pattern in such a way that the patterns are staggered with respect to each other;

wherein the light guide unit comprises a fixing plate, the fixing plate being fixed in the opening of the base, the fixing plate comprising through holes formed therein to correspond, in position, to the light incident sections.

2. The blinking wine bottle stopper according to claim 1, wherein the base comprises a hole formed therein, the hole receiving a power switch mounted therein, the power switch being in electrical connection with the power supply unit.

3. The blinking wine bottle stopper according to claim 1, wherein the fixing plate has an outer circumferential surface forming an external thread, the opening of the base comprising an internal thread corresponding to the external thread of the fixing plate.

4. The blinking wine bottle stopper according to claim 1, wherein the light incident sections of the first light guide plate and the second light guide plate receive a light-shielding sheet arranged therebetween.

* * * * *